US006658800B2

(12) United States Patent
Monson et al.

(10) Patent No.: US 6,658,800 B2
(45) Date of Patent: Dec. 9, 2003

(54) POLYGON-SHAPED STRUCTURAL PANEL AND CONSTRUCTION METHOD FOR GEODESIC DOMES

(76) Inventors: John A. Monson, 32206 SE. 8E 48th St., Falls City, WA (US) 98024; James C. Monson, 832 214th St. SW., Lynwood, WA (US) 98036

( * ) Notice: Subject to any disclaimer, the term of this patent is extended or adjusted under 35 U.S.C. 154(b) by 58 days.

(21) Appl. No.: 09/971,257

(22) Filed: Oct. 4, 2001

(65) Prior Publication Data

US 2002/0078635 A1 Jun. 27, 2002

Related U.S. Application Data

(60) Provisional application No. 60/243,075, filed on Oct. 25, 2000.

(51) Int. Cl.[7] ..... E04B 7/08
(52) U.S. Cl. ..... 52/81.1; 52/81.4; 52/81.5
(58) Field of Search ..... 52/81.1, 81.4, 52/81.5, 80.1, 80.2

(56) References Cited

U.S. PATENT DOCUMENTS

| | | | | | |
|---|---|---|---|---|---|
| 2,682,235 | A | | 6/1954 | Fuller | |
| 3,331,145 | A | * | 7/1967 | Amdahl | 52/81.4 |
| 3,722,153 | A | | 3/1973 | Baer | |
| 3,881,284 | A | * | 5/1975 | Martin | 52/81.1 |
| 3,974,600 | A | | 8/1976 | Pearce | |
| 4,012,872 | A | | 3/1977 | Stolpin | |
| 4,023,317 | A | * | 5/1977 | Bettger et al. | 52/204 |
| 4,071,985 | A | * | 2/1978 | Wickwire | 52/86 |
| 4,241,550 | A | | 12/1980 | Sumner | |
| 4,244,152 | A | | 1/1981 | Harper, Jr. | |
| 4,283,156 | A | | 8/1981 | Harper, Jr. | |
| 4,621,467 | A | | 11/1986 | Golden | |
| 4,625,472 | A | | 12/1986 | Busick | |
| 4,796,394 | A | | 1/1989 | Chastain | |
| 4,907,382 | A | | 3/1990 | Schwam | |
| 4,942,700 | A | | 7/1990 | Hoberman | |
| 5,377,460 | A | * | 1/1995 | Hicks | 52/81.1 |
| 5,379,557 | A | | 1/1995 | Kotter | |
| 5,452,555 | A | | 9/1995 | Lee | |
| 5,706,624 | A | | 1/1998 | Lipson | |
| 5,732,514 | A | * | 3/1998 | Organ | 52/81.1 |
| 6,108,984 | A | | 8/2000 | Davidson | |
| 6,134,849 | A | * | 10/2000 | Holler | 52/80.1 |

* cited by examiner

*Primary Examiner*—Carl D. Friedman
*Assistant Examiner*—Jennifer I. Thissell
(74) *Attorney, Agent, or Firm*—Watts, Hoffmann, Fisher & Heinke

(57) ABSTRACT

A method and structural component for use in constructing geodesic domes using standardized polygon panels. The invention allows for the use of a reduced number of components to construct a geodesic dome. In one embodiment, a set of kite-shaped quadrilateral panels with an external convex surface are used to substantially construct a geodesic dome. A panel includes two lip seal panel edges. The lip seam edge includes an inwardly disposed lip forming a mating surface suitable for mating with an adjacent straight seam edge of a corresponding panel so that the engagement between the two edges forms a seal. The seal may be made to impede moisture by various fastening methods, including screwing, riveting, gluing, taping or welding. Practice of the invention reduces transportation, inventory, and handling expense. Procurement, assembly, and maintenance complexity for the end user is also reduced.

10 Claims, 4 Drawing Sheets

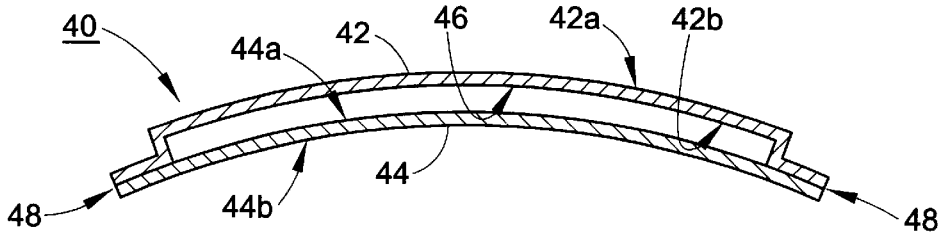
FIG. 2C
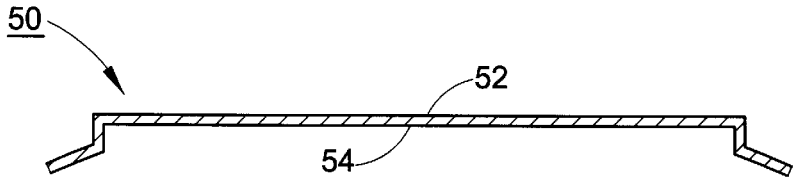
FIG. 2D
FIG. 3A
(PRIOR ART)
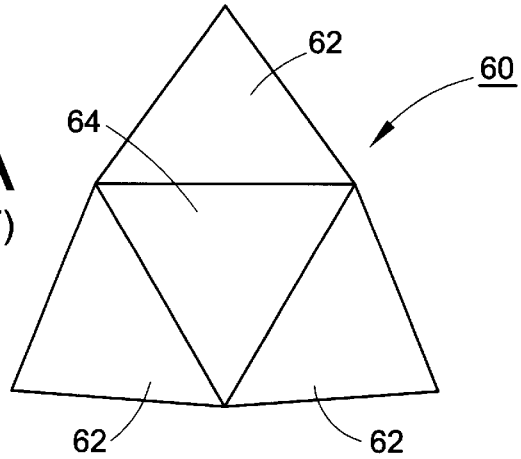
FIG. 3B
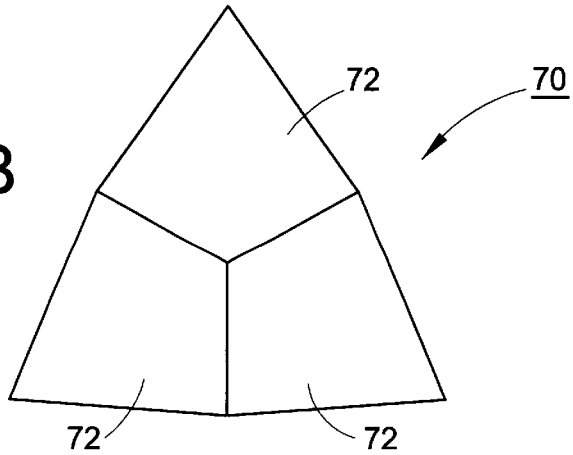

POLYGON-SHAPED STRUCTURAL PANEL AND CONSTRUCTION METHOD FOR GEODESIC DOMES

CROSS-REFERENCE TO RELATED APPLICATIONS

This non-provisional application claims benefit of U.S. Patent Provisional Application Serial No. 60/243,075, entitled "Structural Design System and Construction Methods for Geodesic Domes and Conventional Structures," filed on Oct. 25, 2000.

FIELD OF INVENTION

The present invention is directed to a method and structural component for use in constructing geodesic domes, and more particularly, the invention is directed to a method and structural component for constructing a geodesic dome using standardized polygon-shaped panels.

BACKGROUND ART

A geodesic dome structure is typically formed from numerous lightweight interlocking polygon-shaped bodies. Although the overall shape of the dome is spherical, the individual bodies are often flat panels. Since the geodesic dome was developed and disclosed in U.S. Pat. No. 2,682,235 to Fuller, geodesic dome construction has become well-known in the art. Due to certain inherent advantages of domes, various commercial applications have been developed. Domes are often a desirable construction method for temporary housing, vacation homes, emergency shelters, or remote work sites. Despite the adoption of the geodesic dome as a construction method, concerns with their design have limited their wide-spread use.

Existing dome construction methods and structures share common design goals. Structural strength, cost, ease in assembly, and the ability to weatherproof are desired features. Since domes are often constructed at remote sites, maintaining a simple bill of materials is also advantageous for shipping, inventory, and maintenance concerns.

Many dome designs use multiple polygon-shaped panels connected by various means. Several prior art patents teach the use of triangle-shaped panels. The panels may be joined by wire mesh to form a geodesic dome, or assembled within elongated rods which form the geodesic structure. Other connecting methods include adhesive tape and conventional hardware. These proposals teach using planar panels and forming the dome curvature by the panel connection means. The triangular panels are typically flat and often nearly equilateral.

The prior art fails to disclose a geodesic dome construction apparatus and method in which a dome may be substantially constructed from an inventory of a limited number of structural convex panel sizes utilizing a single connection means. A panel design suitable for use in building a geodesic dome that provides a simple and reliable connection technique is needed in order to simplify the process of dome construction.

SUMMARY OF THE INVENTION

The present invention provides a method and structural component for constructing a geodesic dome using standardized polygon-shaped panels. The invention allows for the use of a minimum set of components to substantially construct a large geodesic dome. Practice of the invention reduces transportation, inventory, and handling expense.

Procurement, assembly, and maintenance complexity for the end user is also reduced.

A structural component panel, constructed in accordance with an exemplary embodiment of the invention, has a polygon-shaped body having an outer surface and an inner surface. The panel further includes a plurality of panel edges such that at least one edge includes a lip seam edge suitable for mating with an adjacent panel edge of a corresponding panel, and a plurality of panel corners defined by the intersection of the panel edges. A plurality of axes are formed such that each said axis leads from a first panel corner to a second panel corner, wherein the second panel corner does not share a common panel edge with said first panel corner.

In one embodiment of the invention, the outer surface of the panel comprises a compound convex curvature. The curvature is such that an integrated assembly of a plurality of the panels substantially forms a geodesic dome structure, wherein a majority of the panels are uniform in shape and size. The panel edges include two or more primary edges and two or more secondary edges, such that the primary edges are longer than the secondary edges, wherein at least one primary edge and at least one secondary edge forms a lip seam edge. The lip seam edge includes an inwardly disposed lip forming a mating surface suitable for mating with an adjacent straight seam edge of a corresponding panel so that the engagement between the two forms a seal. The seal may be made to impede moisture by various fastening methods, including screwing, riveting, gluing, taping or welding.

In another embodiment of the invention, the panel is a kite-shaped quadrilateral. The axes of the kite-shaped panel include a primary axis and a secondary axis, such that the primary axis intersects a corner defined by the intersection of two primary edges. The panel may be symmetric with respect to the primary axis.

A method of constructing a geodesic dome structure is another aspect of the invention. The method includes the steps of selecting a plurality of uniformly shaped construction panels, mating a panel edge of a first panel to a panel edge of a second panel such that a seal is formed, fastening the seal to impede moisture by a fastening method, mating a panel edge of a third panel to a panel edge of the second panel such that a seal is formed and fastened, and repeating the mating and fastening steps, such that a geodesic dome structure is substantially formed.

These and other objects, advantages and features of the invention will become better understood by review of the accompanying detailed description of the best mode of carrying out the invention which is described in conjunction with the accompanying drawings.

BRIEF DESCRIPTION OF THE DRAWINGS

FIG. 2C is a vertical cross-sectional view of the kite panel constructed in accordance with a second alternative embodiment;

FIG. 2D is a vertical cross-sectional view of the kite panel constructed in accordance with a third alternative embodiment;

FIG. 3A is a schematic view of one base combination of prior art panels;

FIG. 3B is a schematic view of one base combination of panels constructed in accordance with one embodiment of the present invention;

FIG. 4A is a schematic view of another base combination of prior art panels;

BEST MODE FOR CARRYING OUT THE INVENTION

The disclosed exemplary embodiment of the present invention addresses the need for an improved structural component panel and method for use in constructing a geodesic dome structure. The improved structural component panel allows for a reduced number of common panel types, less total panels, and reduced material and construction costs.

Figure 1:
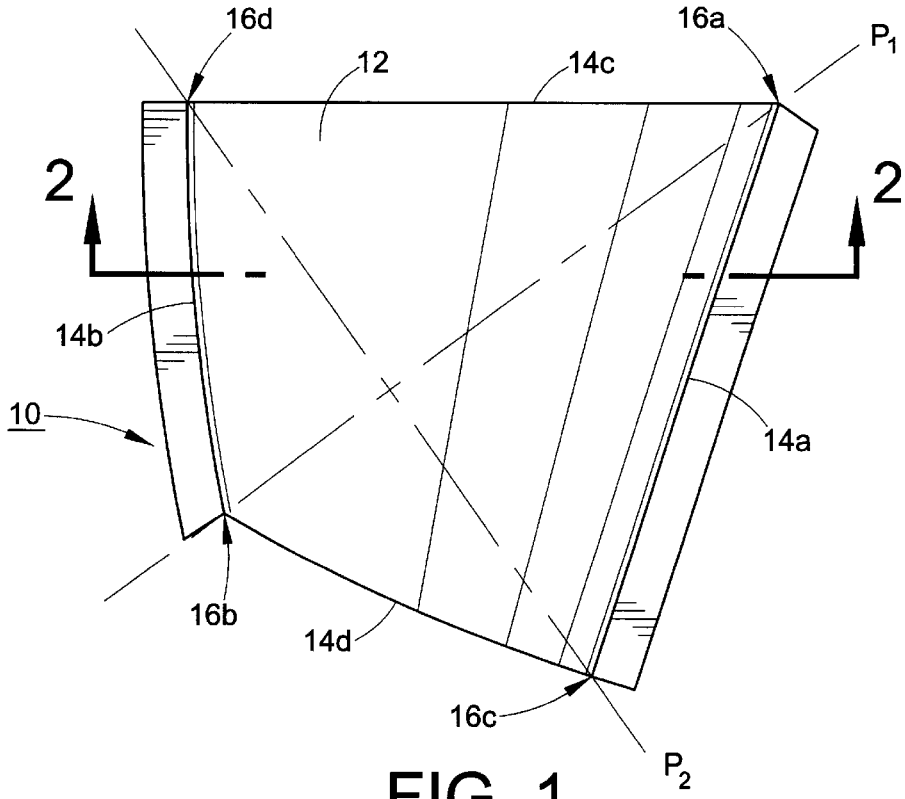
FIG. 1 is a plan view of a kite panel constructed in accordance with one embodiment of the present invention.

Referring now to the drawings, a plan view of a component panel 10 constructed in accordance with one embodiment of the present invention is illustrated in FIG. 1. As illustrated, the panel 10 comprises a polygon-shaped body 12, a plurality of panel edges 14*a*, 14*b*, 14*c*, 14*d*, and a plurality of panel corners 16*a*, 16*b*, 16*c*, 16*d*.

The polygon-shaped body 12 as illustrated is generally kite-shaped. It will be apparent to others skilled in the art that many other suitable polygon shapes can be utilized in light of this disclosure. The polygon-shaped body 12 includes an outer surface 20 and an inner surface 22, best shown in FIG. 2A.

Figure 2A:
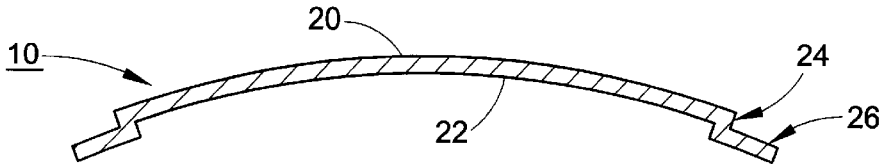
FIG. 2A is a vertical cross-sectional view of the kite panel shown in FIG. 1.

Referring again to FIG. 1, the plurality of panel edges 14*a*, 14*b*, 14*c*, 14*d* include at least one edge having a lip seam edge suitable for mating with an adjacent straight panel edge of a corresponding panel. As illustrated, two panel edges 14*a*, 14*b* include a lip seam edge and two panel edges 14*c*, 14*d* include a straight edge. As illustrated in FIG. 2A, a lip seam edge includes a shoulder portion 24 generally perpendicular to the outer surface 20 and a lower inwardly disposed lip surface 26 generally perpendicular to the shoulder portion 24. As illustrated in FIG. 2A, the length of the shoulder portion 24 is about the same as the thickness of the panel. The inwardly disposed lip surface 26 is adapted to sealingly mate with an adjacent straight edge of a corresponding panel to form a seal.

As stated, a plurality of panel corners 16*a*, 16*b*, 16*c*, 16*d* are defined by the intersections formed by the four panel edges 14*a*, 14*b*, 14*c*, 14*d*. As illustrated in FIG. 1, a plurality of axes $P_1$, $P_2$ are formed. Each axis leads from a first panel corner to a second panel corner, wherein the second panel corner does not share a common panel edge with the first panel corners illustrated, $P_1$ is a primary axis and $P_2$ is a secondary axis. The panel 10 as illustrated is a kite-shaped quadrilateral 12. The quadrilateral 12 is symmetric with respect to the primary axis $P_1$.

The primary axis $P_1$ intersects a corner defined by the intersection of two primary edges 14*a*, 14*c* and a corner defined by the intersection of two secondary edges 14*b*, 14*d*. In the embodiment illustrated in FIG. 1, the panel 10 includes two primary edges 14*a*, 14*c* and two secondary edges 14*b*, 14*d*. The primary edges are longer than the secondary edges in the illustrated embodiment. At least one primary edge 14*a* and at least one secondary edge 14*b* form a lip seam edge.

FIG. 2A is a cross-sectional view of the panel 10 shown in FIG. 1. The outer surface 20 of the panel is convex shaped and the inner surface 22 is concave shaped. It will be apparent to others skilled in the art that many other suitable panel outer surface shapes can be utilized in light of this disclosure. For purposes of example only, the outer surface may include a compound convex curvature. In other words, the radius bend of the panel along the longer primary axis $P_1$ may be unequal to the radius bend of the panel along the shorter secondary axis $P_2$.

Figure 2B:
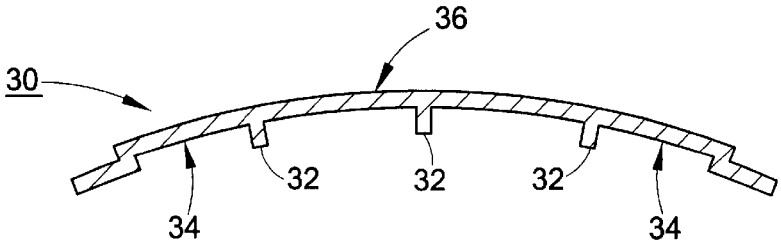
FIG. 2B is a vertical cross-sectional view of a kite panel constructed in accordance with an alternative embodiment.

FIG. 2B is a cross-sectional view of a panel 30 constructed in accordance with an alternative embodiment. The panel 30 includes a plurality of structural ribs 32. As illustrated, three structural ribs are shown, however, any suitable number may be utilized. Each structural rib 32 protrudes from the inner surface 34 of the panel 30. The ribs 32 lead substantially from a first pane edge to a second panel edge, (for example, in FIG. 1, panel edges 14*a*, 14*b*) wherein the second panel edge does not share a common panel corner with the first panel edge. The ribs 32 generally act to give the panel increased structural strength, as compared to the panel 20 illustrated in FIG. 2A. As illustrated, the outer surface 36 is without ribs but ribs may be disposed on the outer surface 36 as well.

FIG. 2C is a cross-sectional view of a panel 40 constructed in accordance with a second alternative embodiment. The panel includes a polygon-shaped main panel body 42 similar to the embodiment illustrated in FIG. 2. As illustrated, the panel 40 of this embodiment further includes a secondary layer 44 having a polygon-shaped body having a top surface 44*a* and an bottom surface 44*b*. The thickness of the secondary layer 44 may be equal to the thickness of the main panel body 42. The secondary layer 44 is adapted to form a seal 48 with the main panel body 42 to form a cavity 46 between the inner surface 42*b* of the main panel body 42 and the top surface 44*a* of the secondary layer 44. The cavity may be used for insulation, mounting hardware, utility installation or other ancillary devices.

FIG. 2D is a cross-sectional view of a panel 50 constructed in accordance with a third alternative embodiment. The panel has an outer surface 52 which is generally planar. As illustrated, the outer surface 52 and an inner surface 54 are parallel to each other.

The present invention can be practiced with panels of various shapes and designs in light of this disclosure. Generally, flat panels are more economical and can be constructed at a lower cost than convex-shaped panels. Flat panels may be produced by converting conventional formed aluminum triangular dome panels to form aluminum kite shape panels. Retooling of existing production methods is required. Convex Kite shaped panels may be formed by thermoforming high-density polyethylene. It will be apparent to others skilled in the art that many other suitable panel creation techniques can be utilized in light of this disclosure.

General dome design will now be briefly discussed. A geodesic dome is typically formed from a series of subdivisions or repetitive "basic building blocks." One measure of the subdivisions of a geodesic dome is the dome's frequency. A discussion of frequency and methods to subdivide a geodesic dome design can be found in "Synergetics—Explorations in the Geometry of Thinking" by R. Buckminster Fuller, MacMillan Publishing Co., Inc., 866 Third Avenue, New York, N.Y. 1975, which is hereby incorporated in its entirety.

Referring now to FIG. 3A, a schematic view of one combination 60 of prior art panels is illustrated. The combination 60 represents a subdivision or "basic building block" of a conventional geodesic dome. As illustrated, the combination 60 includes two different panels types 62, 64 and a total of four panels.

Referring now to FIG. 3B, a schematic view of one combination 70 of panels constructed in accordance with one embodiment of the present invention is illustrated. The combination 70 covers approximately the same area as the conventional combination 60 illustrated in FIG. 3A. However, the combination 70 includes only one panel design 72 and only three total panels, one less panel type than the prior art combination 60. The panels 72 are sealingly joined and may be made to impede moisture by any conventional fastening method including screwing, riveting, gluing, taping and welding.

It is well known in the art, larger domes require more different common panel types and generally, more total number of panels. Referring now to FIG. 4A, a schematic view of one combination 80 of prior art panels is illustrated. Six different panel types 82, 84, 86, 87, 88, 89 and a total of 16 panels are required to form this combination 80.

Figure 4B:
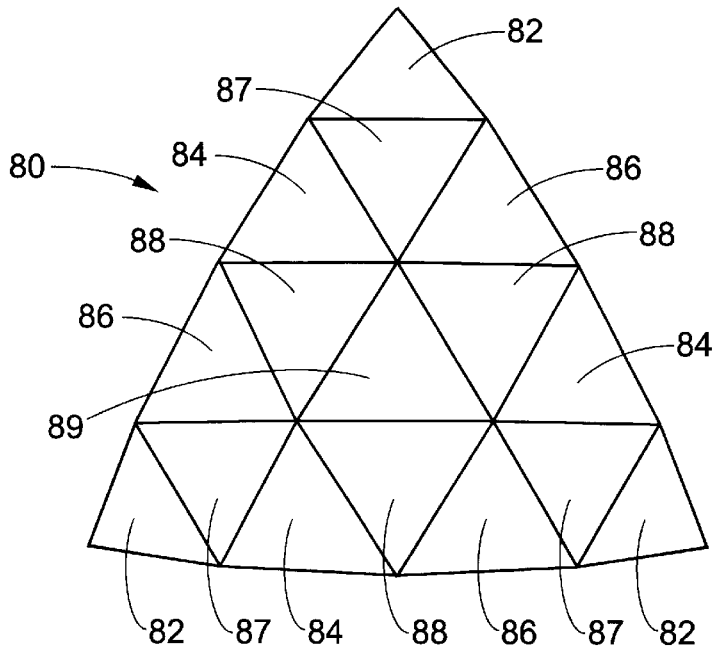
FIG. 4B (PRIOR ART)
FIG. 4B is a schematic view of one combination of panels constructed in accordance with an alternative embodiment of the present invention.
Figure 4B:
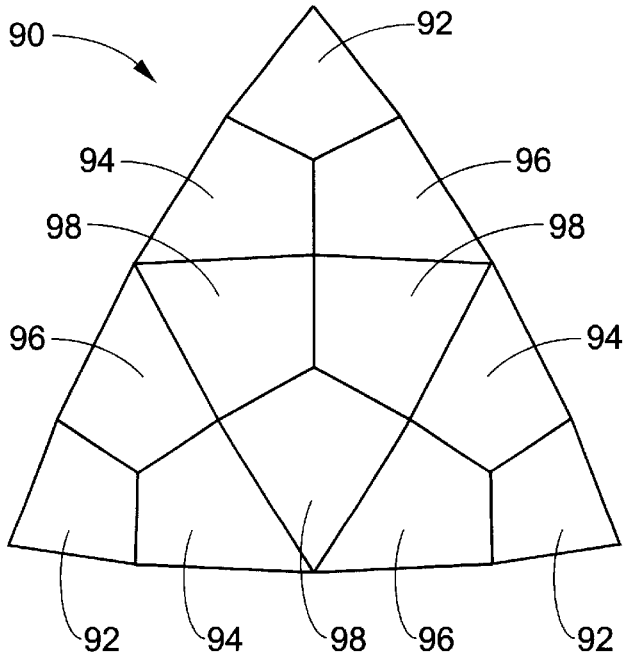

Referring now to FIG. 4B, a schematic view of one combination 90 of panels constructed in accordance with an alternative embodiment of the present invention is illustrated. The combination 90 covers approximately the same area as the conventional combination 80 illustrated in FIG. 4A. However, the combination 90 includes only four panel designs 92, 94, 96, 98 and only twelve total panels, two less panel types than the prior art combination 80 and four less total panels.

Table 1 that follows illustrates the part count and piece count efficiencies offered by the present invention as compared to prior art triangle-shaped panels. For purposes of example only, the subdivisions required for three dome sizes (A, B and C) are represented. It will be apparent to others skilled in the art that many other suitable subdivisions and dome sizes can be utilized in light of this disclosure.

TABLE 1

Part Count and Piece Count Efficiency of Present Invention

| | Common Panel Types | | Panels Per Subdivision | | Total Panels Per Dome | |
|---|---|---|---|---|---|---|
| Dome | Triangle | Kite | Triangle | Kite | Triangle | Kite |
| A | 2 | 1 | 4 | 3 | 40 | 30 |
| B | 6 | 4 | 16 | 12 | 160 | 120 |
| C | 9 | 8 | 36 | 27 | 360 | 270 |

The frequency of each dome represented in Table 1 is as follows. Dome A is 2, Dome B is 4, and the frequency for Dome C is 6. As would be expected by others with ordinary skill in the art, the domes increases in size as the number of panels increases.

As is shown in Table 1, the present invention offers fewer number of common panel types and fewer total panels for the same size dome. As a result, the present invention yields a simplified bill-of-materials. The production is subsequently more efficient and less costly than conventional dome designs.

Figure 5:
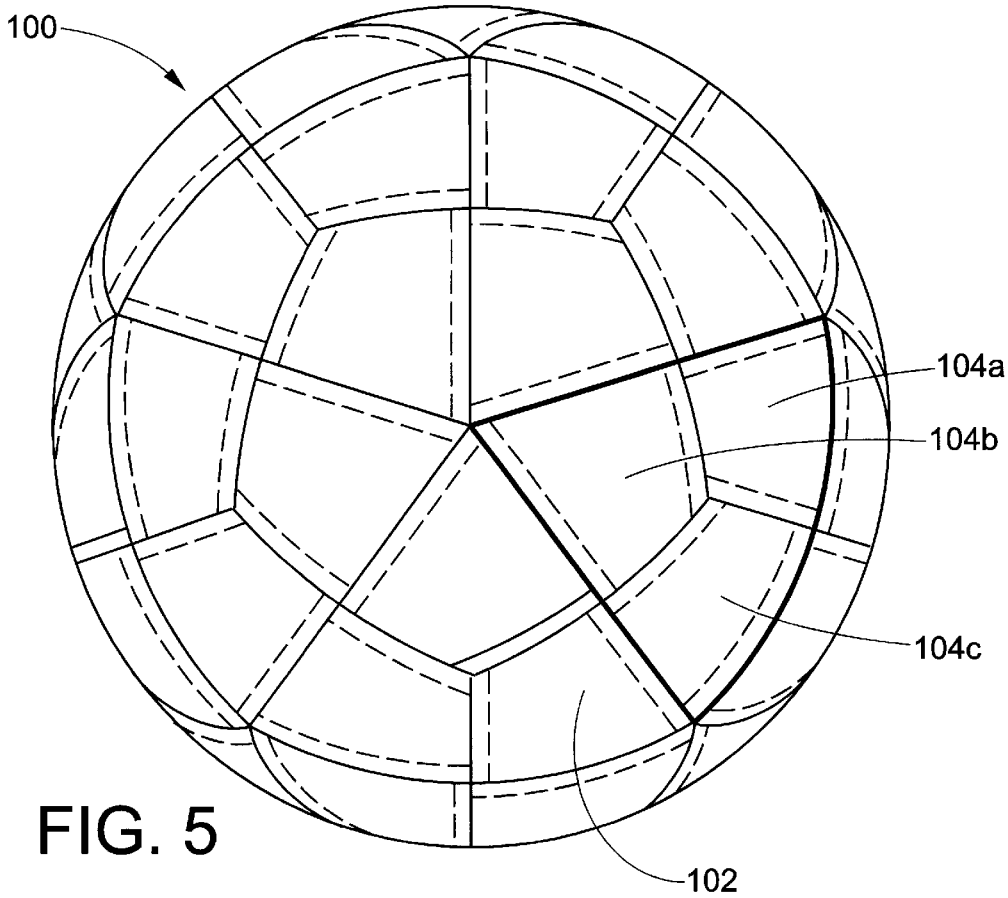
FIG. 5 is a plan view of a geodesic dome substantially constructed from a group of standardized kite panels as shown in FIGS. 1, 2A and 3B.
Figure 6:
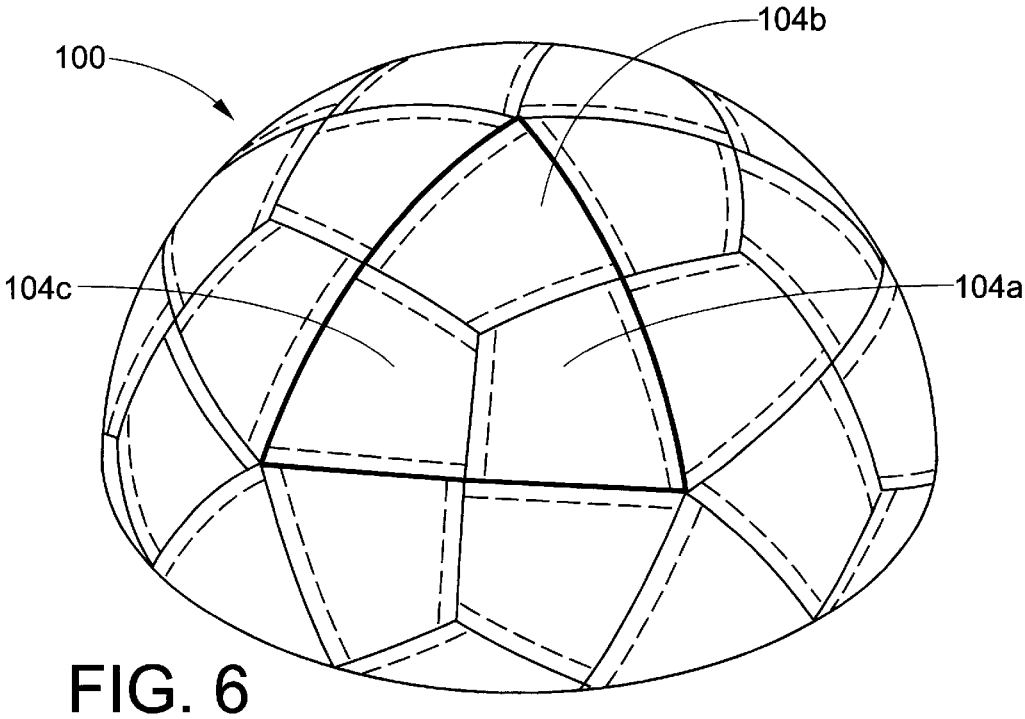
FIG. 6 is a perspective view of the geodesic dome shown in FIG. 5.

Referring now to FIG. 5, a plan view of a geodesic dome substantially constructed from a group of standardized kite panels as shown in FIGS. 1, 2A and 3B is illustrated. The panels 102 as illustrated have a convex compound curvature such that an integrated assembly of a plurality of the panels substantially forms a geodesic dome structure. As illustrated, a majority of the panels 102 are uniform in shape and size. A repetitive subdivision is formed by three standardized panels 104*a*, 104*b*, 104*c*. A perspective view of a geodesic dome shown in FIG. 5 is illustrated in FIG. 6.

A method of constructing a geodesic dome structure in accordance with one embodiment of the present invention will now be discussed. The method includes the first step of selecting a plurality of construction panels which include a kite-shaped body having a convex outer surface, an inner surface, four panel edges such that two edges include a lip seam edge suitable for mating with an adjacent panel edge of a corresponding panel and four panel corners defined by the intersection of the four panel edges. Two axes are formed such that each axis leads from a first panel corner to a second panel corner, wherein the second panel corner does not share a common panel edge with the first panel corner.

The second method step includes mating a panel edge of a first panel to a panel edge of a second panel, such that a seal is formed, wherein the first panel and the second panel may be uniformly shaped and dimensioned.

The next method step includes fastening the seal to impede moisture by a fastening method selected from the group consisting of screwing, riveting, gluing, taping and welding.

The next method step includes mating a panel edge of a third panel to a panel edge of the second panel, such that a seal is formed and fastened, wherein the second panel and the third panel may be uniformly shaped and dimensioned. The steps of mating and fastening are repeated such that a geodesic dome structure is substantially formed.

In one embodiment, the panel may include a pair of primary edges and a pair of secondary edges, wherein each pair includes a straight seam edge and a lip seam edge, such that a first panel primary straight seam edge suitably mates with a second panel primary lip seam edge, and the first panel secondary straight seam edge suitably mates with a third panel secondary lip seam edge.

In one embodiment, the panel may include a kite-shaped quadrilateral, wherein the quadrilateral is symmetric with respect to a primary axis, such that said primary axis intersects a corner defined by the intersection of said pair of primary edges.

Although the present invention has been described with a degree of particularity, it is the intent of the Applicant that the invention include all modifications and alterations apparent to those skilled in the art from the above detailed description and within the spirit or scope of the appended claims.

What is claimed:

1. A structural component panel, for use in constructing a geodesic dome structure, comprising:

a kite-shaped quadrilateral body having an outer surface and an inner surface;

four panel edges, wherein said panel edges comprise two primary edges and two secondary edges, such that said primary edges are longer than said secondary edges, wherein one primary edge and one secondary edge each form a lip seam edge suitable for mating with an adjacent panel edge of a corresponding panel, wherein said two lip seal edges do not intersect; and four panel corners defined by the intersection of said panel edges;

wherein a primary axis and a secondary axis are formed such that said primary axis intersects a corner defined by an intersection of said two primary edges, wherein said quadrilateral is symmetric with respect to said primary axis;

wherein said panel has structure such that an integrated assembly of a plurality of said panels having uniform shape and size substantially forms a geodesic dome structure.

2. The panel of claim 1 wherein said outer surface is convex.

3. The panel of claim 1 wherein said outer surface is a generally planar surface.

4. The panel of claim 1 wherein said outer surface comprises a compound convex curvature.

5. The panel of claim 1 wherein said inner surface is concave.

6. The panel of claim 1 wherein each said lip seam edge comprises an inwardly disposed lip forming a mating surface suitable for mating with an adjacent straight seam edge of a corresponding panel to form a seal.

7. The panel of claim 6 wherein said seal is made to impede moisture by a fastening method selected from the group consisting of screwing, riveting, gluing, taping and welding.

8. The panel of claim 1 wherein said body comprises a plurality of structural ribs protruding from said inner surface and leading substantially from a first panel edge to a second panel edge, wherein said second panel edge does not share a common panel corner with said first panel edge.

9. The panel of claim 1 comprising a secondary layer comprising a polygon-shaped body having a top surface and an bottom surface, wherein said secondary layer is adapted to sealingly mate with said panel body forming a cavity between the inner surface of said panel body and the top surface of said secondary layer.

10. A method of constructing a geodesic dome structure comprising the steps of:

selecting a plurality of construction panels, wherein said panels comprise:

a) a kite-shaped quadrilateral body having an outer surface and an inner surface;

b) four panel edges, wherein said panel edges comprise two primary edges and two secondary edges, such that said primary edges are longer than said secondary edges, wherein one primary edge and one secondary edge each form a lip seam edge suitable for mating with an adjacent panel edge of a corresponding panel, wherein said two lip seal edges are non-intersecting; and c) four panel corners defined by the intersection of said panel edges;

d) wherein a primary and a secondary axis are formed such that said primary axis intersects a corner defined by an intersection of said two primary edges, wherein said quadrilateral is symmetric with respect to said primary axis;

e) wherein said selected panels are uniform in shape and size;

mating a panel edge of a first panel to a panel edge of a second panel, such that a seal is formed, wherein said first panel and said second panel may be uniformly shaped and dimensioned;

fastening said seal to impede moisture by a fastening method selected from the group consisting of screwing, riveting, gluing, taping and welding;

mating a panel edge of a third panel edge of said second panel, such that a seal is formed and fastened, wherein said second panel and said third panel may be uniformly shaped and dimensioned; and repeating the mating and fastening steps, such that a geodesic dome structure is substantially formed.

* * * * *